United States Patent [19]

Darlington

[11] 4,079,723

[45] Mar. 21, 1978

[54] COMPOUND BOW

[76] Inventor: Rex F. Darlington, 3540 Darton Rd., Hale, Mich. 48739

[21] Appl. No.: 712,493

[22] Filed: Aug. 9, 1976

[51] Int. Cl.[2] ..... F41B 5/00

[52] U.S. Cl. ..... 124/24 R; 124/90; 124/89

[58] Field of Search ..... 124/24 R, 23 R, 90, 124/86, 89, 22

[56] References Cited

U.S. PATENT DOCUMENTS 3,486,495 12/1969 Allen ..... 124/24 R 3,990,425 11/1976 Ketchum ..... 124/23 R

*Primary Examiner*—Richard C. Pinkham

*Assistant Examiner*—William R. Browne

*Attorney, Agent, or Firm*—Barnes, Kisselle, Raisch & Choate

[57] ABSTRACT

A compound bow structure with a bow grip and arrow sight window offset to one side of the bow center with an overcenter pulley at the flexing ends guiding the nocking stretch centrally of the grip and additional tension cables centrally of the flexing limbs wherein the full draw tension is central of the limbs to avoid twisting of the limbs in draw.

3 Claims, 6 Drawing Figures

Figure 1:
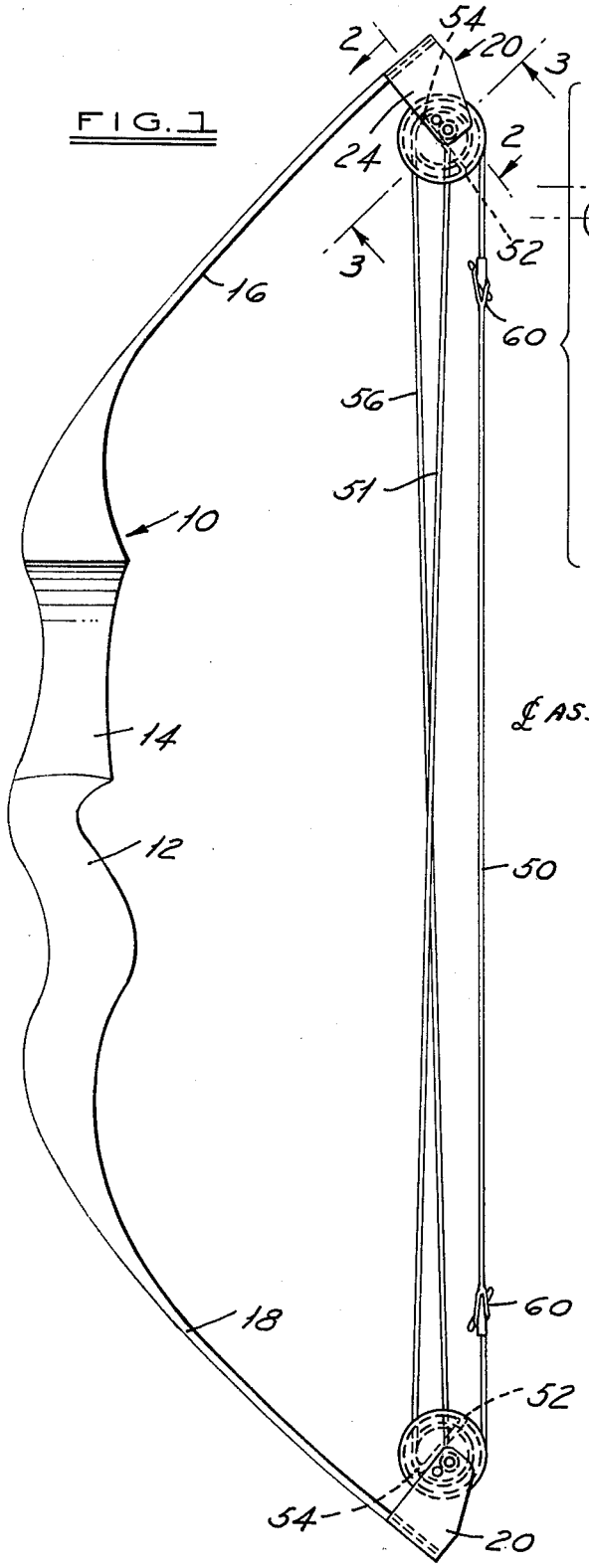

54
20
2
3
24
2
3
52
16
60
56
51
10
14
12
50
18
60
52
54
20

16
26
28
30
36
FORCE ℄
ASSEMBLY ℄
37
22
42
41
34
32
42
40

℄ ASSEMBLY
20
44
46
16
CENTER OF FORCE
AT FULL DRAW 30
24
36
37
32
34
28
24

COMPOUND BOW

This invention relates to improvements in a Compound Bow and more particularly to a simple design for a compound bow which is balanced in the forces acting on the limbs to avoid twisting.

With a single string bow, the bow string can be accurately centered and when the string is drawn, there is no change of forces other than the increased tension. However, with a compound bow, that is, a bow which has an eccentric pulley action which reduces needed hand power beyond a certain point in the draw, there are changes in force application as well as in tension.

It is common in a compound bow to have several pulleys at the end of the flexing limbs. Since these pulleys are most conveniently spaced on a common axis, some are necessarily offset from the center of the bow arms and handle. This offset is also required to provide arrow clearance. Because of this, even if a bow is balanced in an undrawn state at full draw, there is a tendency to pull the bow limbs in a twisting action. This contributes to a recoil torque which can affect the aim and also may affect the overall condition of the bow in prolonged use.

With a standard bow, the centerline of the handle is in line with the bowstring and centered relative to the flexing limbs of the bow. When a compound bow is used, there are additional cords or cables in the bow arch which must be cleared by the arrow. This usually results in the nocking stretch being placed to one side of the bow and the arrow is then being shot across the bow at an angle to a center plane through the limbs.

In the present invention, the bow handle and arrow window are positioned at one side of the bow, off the centerline of the flexing limbs. The nocking stretch is also positioned to the same side (left or right, depending on whether it is a right-hand or left-hand bow) so that the handle, arrow window, and nocking area are directly in line but offset from the center of the flexing limbs. The pulleys of the bow nocking stretch and the cables are arranged in a tip assembly which is centered relative to the flexing limbs, but the forces on the cables are such that as the bow is drawn, the maximum force transfers from the off-center nocking stretch to the center of the tip assembly and thus to the center of the flexing limbs. This reduces the twisting force on the limbs and provides a balanced structure.

It is an object of the present invention to provide a structure which will eliminate this undesirable twist. This is accomplished by a unique pulley arrangement augmented by an asymmetrical design of a flexing arm.

Another object is the provision of a bolt lock for the bow pulleys to provide safety and to comply with requirements directed at the prohibition of having a strung bow in a vehicle. A compound bow is never unstrung under ordinary circumstances.

A still further object is the provision of a balance pin extending in a direction to compensate further for any unbalance.

Other objects and features of the invention will be apparent in the following specification and claims in which the invention is described and a disclosure made which will enable a person skilled in the art to make the invention, all in connection with the best mode presently contemplated for the practice of the invention.

DRAWINGS accompany the disclosure and the various views thereof are described as:

FIG. 1, a side view of the strung compound bow.

Figure 2:
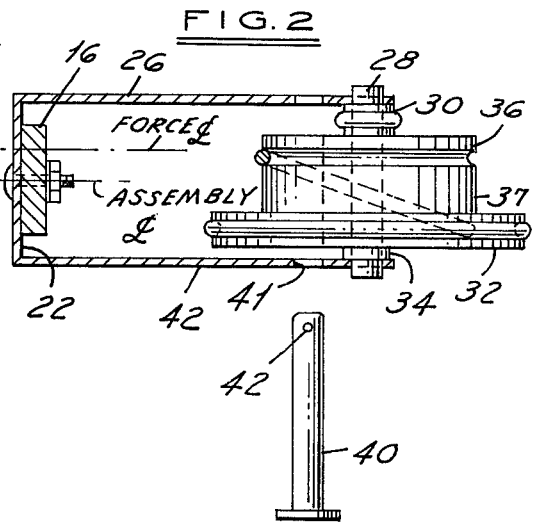

FIG. 2, a view partially in section on line 2—2 of FIG. 1 showing the pulley system at one end.

Figure 3:
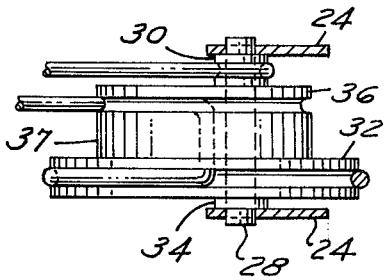

FIG. 3, a view partially in section on line 3—3 of FIG. 1 showing the eccentricity of the pulleys.

Figure 4:
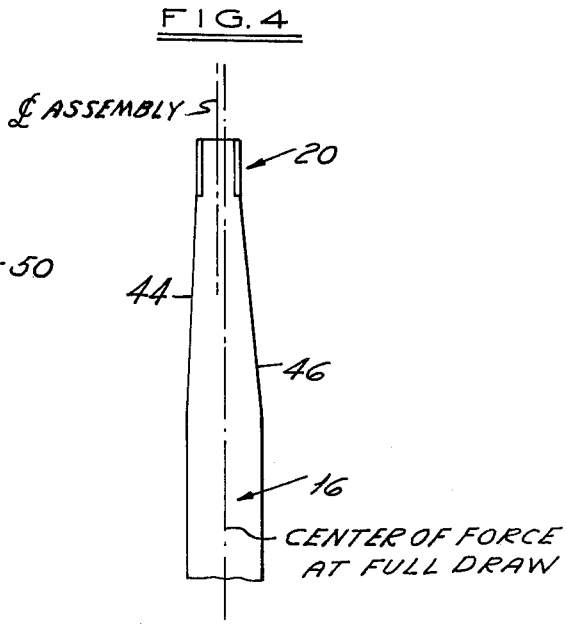

FIG. 4, a view of a flexing limb of the bow showing the asymmetrical configuration.

Figure 5:
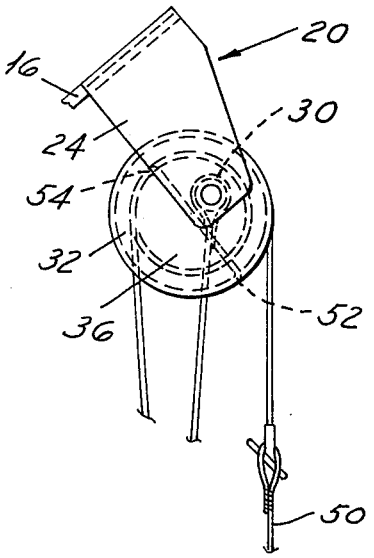

FIG. 5, an enlarged side view of a bow end showing the cable path.

Figure 6:
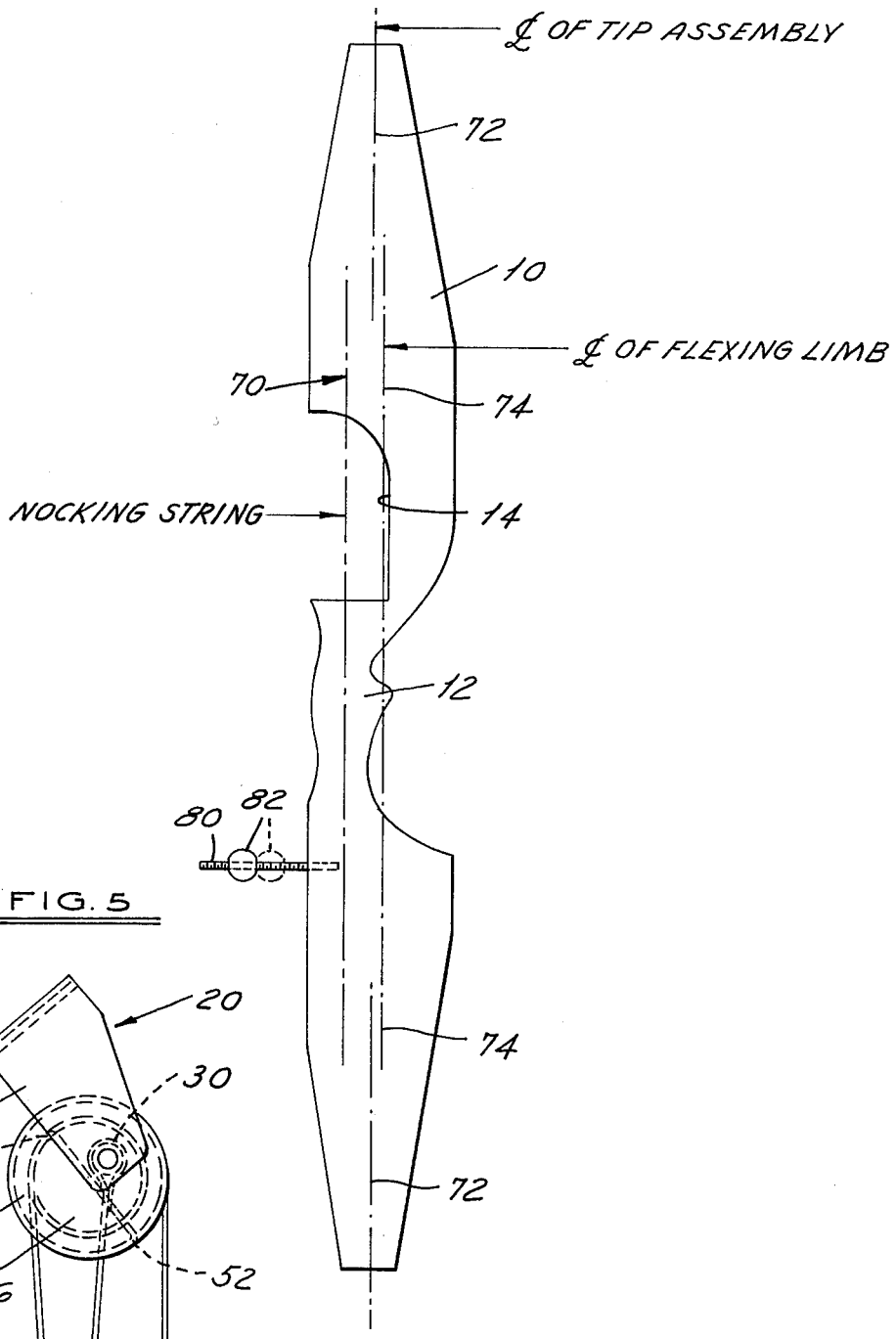

FIG. 6, a view of the central handle portion of the bow from the archer's side.

With reference to the drawings: In FIG. 1 a compound bow is illustrated having a main handle section 10 with a grip 12, a sight window 14, and terminating in upper and lower flexing limbs 16 and 18.

At each free end of the flexing limbs in a bifurcate U-shaped bracket 20, the base 22 of the bracket being securely fastened to the limb 16 and the sides or arms 24 and 26, approximating triangles, extending toward the archer's position. An axle or shaft 28 is mounted between the sides of the bracket 20 to provide a support for a pulley system. A small pulley 30 (1 centimeter plus or minus) is concentrically mounted on the shaft 28 to serve as an anchor capstan for the bowstring. This anchor capstan is mounted near side 26 of the bracket. It will be appreciated that the cable could be anchored directly on the shaft 28 or on the bracket itself.

A relatively large pulley 32 (5 to 6 centimeters) is mounted on the shaft 28 near the other side 24 of the bracket, spaced off the bracket side by a spacer 34. A smaller pulley 34 (4 to 5 centimeters) is mounted adjacent to, and connected to rotate with, the larger pulley 32. The two pulleys 32 and 36 may be molded integrally if desired with a connecting body 37. These two pulleys are concentric to each other and mounted eccentrically on the shaft 28, as shown in FIG. 3, on an axis a little more than two-thirds along the diameter which passes through the mounting pin. It will be appreciated that the dimension given above is exemplary for a particular mode presently found to be satisfactory.

Circumferentially spaced, axially directed holes are provided within the periphery of the pulleys 32 and 36 to receive the shank of a headed blocking bolt 40 which will prevent operation of the bow when passed through an opening 41 in bracket wall 24. If need be, by regulation, the bolt 40 can be secured by a cotter pin or even a small padlock through a hole 42.

The flexing limbs 16 and 18 of the bow are formed a little differently than the usual limb to compensate for the placement of the bracket 20. As illustrated in FIG. 4, the limb 16 has an angled side 44, on the left, leading to the end bracket and a side 46 at a slightly different angle.

The main object of the invention is to have the heavy draw stress of the bow centered on the end brackets under conditions of full draw. This is accomplished in a manner which will be evident in the following description relative to the stringing and operation of the bow.

As illustrated in FIG. 1, the string originates at an anchor capstan 30 at the top of the bow and passes in a run 51 down to the other end of the bow to the outside of the smaller pulley 36. (By "outside" is meant the side nearest the bow and away from the archer.) It goes partly around the smaller pulley 36 and then passes into a diametrical hole which angles laterally toward the larger pulley 32 at the bottom of the bow. It comes out in the larger pulley 32 on the inside and passes around this pulley into the bowstring nocking area 50. The return run at the top of the bow, illustrated in FIG. 5, is around the larger pulley 32 to a point 52 where the cable enters the pulley block diametrically and angled laterally toward the pulley 36. It comes out at 54 on pulley 36 and passes over a portion of pulley 36 into a run 56 down to the anchor capstan 30 at the bottom of the bow. As shown in FIG. 1, the nocking run 50 can be a separate portion with end loops 60 to engage hooks on the drive cables.

Thus, it will be noted that the nocking run 50 extends to the two larger pulleys 32 which are at the extreme left on the bow structure when facing the window 14 on the line 70 shown in FIG. 6. This line is considerably off center of the bow structure but since these larger pulleys do not carry the main load when the bow is drawn, there is no destructive distortion. As illustrated in FIG. 6, the centerline 70 of grip 12 and the sight window 14 are in line with the bowstring 50 so that when the arrow is drawn, there is a straight pull back and no need to aim the arrow across, that is, at an angle to the general plane of the bow.

The pulleys 32 are on the centerline 70 of the grip assembly and offset from the center of the tip assembly but when the bow is drawn, the tension force transfers to a considerable degree from the nocking run or stretch 50 to the two runs 51 and 56, each extending from an off center anchor capstan 30 to a centered pulley 36. The centerline 74 of the flexing limbs is still to the right of the centerline 72 of the tip assembly and just about midway between the pulleys 32 and the anchors 30.

Thus, at full draw, the resultant bow cable tension is essentially balanced centrally of the bow limbs. This avoids twisting of the bow limbs at draw conditions. Under these conditions, when an arrow is released, there is a balanced condition which greatly reduces and practically eliminates any torquing reaction on the bow structure.

For very fine tuning of the bow, a counter-balance rod 80 may be mounted on the bow extending to the left of the archer for the bow shown. Since the grip is off center to the left of the general bow center of gravity, a balance can be obtained by the weight extending to the left. A weight 82 threaded on the rod may be adjusted in and out to achieve an exact balance for any particular archer. For a lefthand bow, the balance rod would extend to the right.

In addition, the structure of the flexing arms 16, as previously described, and as illustrated in FIG. 4, provides additional resistance to any twisting of the bow under drawn conditions and further reduces any tendency toward release torquing.

Thus, it will be seen that the location of the grip and sight window at the string side of the compound bow allows the positioning of the arrow perpendicular to the general plane of the bow handle and limbs, and avoids the awkwardness of shooting the arrow at a cocked angle to this plane. In addition, the arrangement of the pulleys and anchor points provides a system wherein the maximum tension forces of the bow at full draw are shifted from a position off center of the bow limbs, as at pulley 32, to a position essentially central of the flexing limbs. This avoids a twisting force on the limbs and eliminates arrow-release torquing.

While the overcenter action of the pulleys has not been described in detail, it will be appreciated that the eccentric mounting of the pulleys 32 and 36 causes a reduction in draw force as the nocking string is pulled back in the same manner as described in a U.S. Pat. to Allen, No. 3,486,495, issued Dec. 30, 1969.

What I claim is:

1. In a compound bow having a force mechanism to decrease torque in the bow during the draw, that improvement which comprises:

(a) a bow handle having a grip portion and an arrow window vertically adjacent said grip portion, said grip portion having a vertical centerline, (b) flexing limbs extending from said bow handle having a centerline spaced laterally from the centerline of said grip portion, (c) a pulley bracket on the free end of each said flexing limb having a main pulley, a secondary pulley and an cable anchor point spaced laterally from one side of said bracket to the other, said main pulley lying directly behind the centerline of said grip, said secondary pulley being positioned in the central region of said flexing limbs offset from the centerline of the grip in the direction of the centerline of the limbs, and (d) a cable run from said anchor points to said respective pulleys including a nocking stretch between said main pulleys, and cable runs between said anchor points and said secondary pulleys wherein resultant draw tension at full draw is transferred from the grip assembly centerline to a position substantially central of said pulley brackets and on the centerline of said flexing limbs.

2. In a compound bow having a force mechanism to decrease torque in the bow during the draw, that improvement which comprises:

(a) a bow handle having a grip portion and an arrow window vertically adjacent said grip portion and having a vertical centerline, (b) flexing limbs extending from said bow handle having a centerline spaced laterally from the centerline of said grip portion, (c) a bow cable including a nocking stretch, and (d) pulley means and anchor points for said cable on each said fleximg limbs, said pulley means comprising a primary nocking stretch pulley on each fleximg limb to position said nocking stretch directly behind said centerline of said grip portion, and a secondary pulley on each flexing limb offset from the centerline of said grip portion in the direction of the centerline of said limbs to position portions of said cable between said anchor points and said nocking stretch in the central region of said flexing limbs to balance the high tension forces on said cable at full draw centrally of said limbs.

3. In a compound bow having a force mechanism to decrease torque in the bow during the draw, that improvement which comprises:

(a) a bow handle having a grip portion and an arrow window vertically adjacent said grip portion, (b) flexing limbs extending from said bow handle, (c) a bracket extending transversely of the free end of each said limb, (d) means forming first and second pulleys and a cable anchor point spaced from one side of each bracket to the other, said first pulleys is the bracekets lying in a common plane coincident with the centerline of said grip portion and positioned on one side of each bracket, each said second pulley being positioned centrally of its associated bracket, and each said cable anchor point being positioned on the other side of its associated bracket, and (e) cable runs from said anchor points to said respective pulleys including a nocking stretch in said plane between said first pulleys wherein resultant draw tension at full draw is transferred from the center line of the notching stretch to the centerline of said flexing limbs to prevent twisting of said limbs, (f) each said cable run originating at an anchor point at one end of said bow and extending to and around a portion of the circumference of a second pulley at one end, and thence diametrically to and around a first pulley, and thence to a nocking run between said first pulleys, diametrically back to a second pulley at the other end, and thence to the anchor point at the other end of the bow.

* * * * *

UNITED STATES PATENT AND TRADEMARK OFFICE

CERTIFICATE OF CORRECTION

PATENT NO. : 4,079,723

DATED : March 21, 1978

INVENTOR(S) : REX F. DARLINGTON

It is certified that error appears in the above-identified patent and that said Letters Patent are hereby corrected as shown below:

Claim 3 (Col. 4, line 62), change "is" to -- in --.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*